US006024889A

United States Patent [19]

Holland et al.

[11] Patent Number: 6,024,889

[45] **Date of Patent: *Feb. 15, 2000**

[54] CHEMICALLY ACTIVE FIRE SUPPRESSION COMPOSITION

[75] Inventors: Gary F. Holland, Snohomish; Michael A. Wilson, Kirkland, both of Wash.

[73] Assignee: Primex Technologies, Inc., St. Petersburg, Fla.

[ * ] Notice: This patent is subject to a terminal disclaimer.

[21] Appl. No.: 09/015,359

[22] Filed: Jan. 29, 1998

[51] Int. Cl.[7] ..... A62C 31/02; A62C 35/00; A62C 35/02; A62C 2/00; C06B 31/02

[52] U.S. Cl. ..... 252/5; 252/4; 252/7; 169/46; 169/12; 169/26; 169/61; 149/61

[58] Field of Search ..... 252/4, 5, 7; 169/46, 169/12, 26, 61; 149/61

[56] References Cited

U.S. PATENT DOCUMENTS

| | | | |
|---|---|---|---|
| 3,972,820 | 8/1976 | Filter et al. | 252/5 |
| 4,601,344 | 7/1986 | Reed, Jr. et al. | 169/47 |
| 5,055,208 | 10/1991 | Stewart et al. | 252/8 |
| 5,423,384 | 6/1995 | Galbraith et al. | 169/12 |
| 5,423,385 | 6/1995 | Baratov | 169/46 |
| 5,425,886 | 6/1995 | Smith | 252/5 |
| 5,441,114 | 8/1995 | Spector et al. | 169/14 |
| 5,449,041 | 9/1995 | Galbraith | 169/11 |
| 5,465,795 | 11/1995 | Galbraith et al. | 169/11 |
| 5,466,386 | 11/1995 | Stewart et al. | 252/2 |
| 5,520,826 | 5/1996 | Reed, Jr. et al. | 252/5 |
| 5,545,272 | 8/1996 | Poole et al. | 149/48 |
| 5,609,210 | 3/1997 | Galbraith et al. | 169/26 |
| 5,613,562 | 3/1997 | Galbraith et al. | 169/12 |
| 5,641,938 | 6/1997 | Holland et al. | 149/48 |
| 5,661,261 | 8/1997 | Ramaswamy et al. | 149/36 |
| 5,780,768 | 7/1998 | Knowlton et al. | 149/36 |
| 5,833,874 | 11/1998 | Stewart et al. | 252/8 |

FOREIGN PATENT DOCUMENTS 97 33653 10/1997 WIPO .

OTHER PUBLICATIONS

Shimizu et al., "Gas–forming Compositions", *Chemical Abstracts,* vol. 84, No. 18, p. 138 (1976).

Ewing et al., J. Fire Prot. Engr. 4(2), 1992.

*Primary Examiner*—D. Gabrielle Brouillette
*Assistant Examiner*—LaToya Cross
*Attorney, Agent, or Firm*—Todd E. Garabedian; Wiggin & Dana

[57] ABSTRACT

The invention is directed to a chemically active fire suppression composition, comprising a propellant comprising a fuel and an oxidizer, the propellant capable of generating inert gas; and an environmentally innocuous chemical fire suppressant capable of generating fire suppressive reactive species. The combination of physically acting fire suppression agents and chemically acting, environmentally innocuous fire suppression agents results in a highly effective, environmentally innocuous fire extinguishing composition that has low ozone depletion potential (ODP), low global warming potential (GWP), and high suppression efficiency.

6 Claims, 2 Drawing Sheets

CHEMICALLY ACTIVE FIRE SUPPRESSION COMPOSITION

BACKGROUND OF THE INVENTION

1. Field of the Invention

The invention relates to fire suppression compositions, and more particularly to fire suppression compositions that are environmentally innocuous, and that act both physically and chemically to extinguish fires.

2. Brief Description of the Art

Halogen-containing agents, such as Halon 1211 (bromochlorodifluoromethane, $CF_2BrCl$) and Halon 1301 (trifluorobromomethane, $CF_3Br$) have been utilized as effective fire suppression agents for many years. These fire suppression agents generate chemically reactive halogen radicals which interfere with the combustion process, and provide an important advantage to the fire extinguishing capability of Halons. However, certain halogen-containing fire suppression agents, such as Halon-1301, contribute significantly to the destruction of stratospheric ozone in the atmosphere. Halon 1301 is a volatile compound and upon high altitude photolysis, Halon 1301 forms reactive chemical radicals that react with ozone ($O_3$) to produce oxygen ($O_2$).

$CF_3Br+hv \rightarrow CF_3.+Br.$ $Br.+O_3 \rightarrow BrO.+O_2$ $BrO.+O_3 \rightarrow Br.+2\ O_2$ In order to reduce stratospheric ozone depletion caused by Halons, nearly all commercially available fire suppression agents that are designed today are "physically acting" agents. In other words, these fire suppression agents use physical properties rather than chemical properties to suppress fires. Examples of physically-acting fire suppression agents include inert gases such as carbon dioxide ($CO_2$), water vapor ($H_2O$) and nitrogen ($N_2$). When applied to a fire, these inert gases is physically displace oxygen from the combustion region while simultaneously serving as a heat sink to reduce the temperature of the combustion zone. The combination of these two physical actions results in extinction of the fire. An example of this type of fire suppression agent is U.S. Pat. No. 5,423,384, to Galbraith et al. which describes an apparatus that delivers liquid and solid fire suppression agents such as water vapor, carbon dioxide, and nitrogen gas.

Unfortunately, physically-acting fire suppression agents are less efficient than chemically-acting fire suppression agents. Accordingly, larger quantities of physicially-acting fire suppressant are required in order to extinguish fires. Consequently, bulky equipment and larger storage containers must frequently be used in conjunction with physically-acting fire suppression agents. The bulky nature of this equipment is a disadvantage in certain applications where space is limited, such as military or civilian aircraft or ground vehicle engine bays, spacecraft, or military or civilian aircraft drybays.

Solid propellant formulations similar to those used in rocket engines and automotive airbags have recently found new applications as physically-acting fire suppression agents. The gases formed from solid propellant-based fire suppression agents As offer advantages such as low ozone depletion potential (ODP), and low environmental impact. For example, solid propellant compositions based on sodium azide fuel and inorganic oxidizers generate nearly pure inert nitrogen gas. Similarly, azide-free formulations offer improved efficiencies for production of large volumes of chemically inert gas mixtures with minimal levels of noxious gases. In addition to these advantages, solid propellants are capable of generating large amounts of chemically inert gases (mainly $CO_2$, $N_2$, $H_2O$) from relatively small amounts of solid materials. Thus, the effective storage density for such fire suppression agents is high. However, as indicated above, such systems generally suffer from reduced efficiency due to heavy reliance upon physical fire suppression activity rather than the more efficient chemical fire suppression activity.

Additional fire extinguishing materials and methods are known in the art, many of which are directed to physical methods of extinguishing fires. For example, U.S. Pat. No. 4,601,344 to Reed et al. describes a fire extinguishing method that utilizes a gas generating composition comprising glycidyl azide polymer and a high nitrogen content solid additive, such as guanylaminotetrazole nitrate, bis (triaminoguanidium)-5,5'-azotetrazole, ammonium 5-nitroaminotetrazole, and high bulk density nitroguanidine.

U.S. Pat. No. 5,520,826 to Reed et al. discloses a fire extinguishing method that utilizes a gas generating composition comprising glycidyl azide polymer, an azido plasticizer, a high nitrogen content solid additive, and the potassium salt of perfluorooctanoic acid. Aromatic bromine additives may be added to the composition as a chemical fire suppressant; however, such additives are hazardous to human health and the environment.

U.S. Pat. No. 5,423,385 to Baratov et al. describes formulations of fire extinguishing aerosols which include an oxidant and a reducing agent. The compositions of these aerosols extinguish fires using a combination of heat absorption and chemical interaction.

U.S. Pat. No. 3,972,820 to Filter et al. describes a fire extinguishing composition that comprises a halogen-containing fire extinguishing agent, an oxidizer, and a binder. However, the organic species that are generated are typically considered carcinogenic and environmental health hazards.

Accordingly, what is needed in the art is a fire suppression composition that provides the benefits of both physical fire suppression and chemical fire suppression, and that is environmentally innocuous. The present invention is believed to be an answer to that need.

SUMMARY OF THE INVENTION

In one aspect, the invention is directed to a chemically active fire suppression composition, comprising a propellant comprising a fuel and an oxidizer, the propellant capable of generating inert gas; and an environmentally innocuous chemical fire suppressant capable of generating fire suppressive reactive species.

In another aspect, the present invention is directed to a chemically active fire suppression composition, comprising a propellant comprising a fuel and an oxidizer, the fuel comprising from about 10 to about 50% by weight of the composition, the oxidizer comprising from about 20 to about 90% by weight of the composition, the propellant capable of generating inert gas; and an environmentally innocuous chemical fire suppressant capable of generating fire suppressive reactive species, the environmentally innoucuous chemical fire suppressant selected from the group consisting of potassium iodide, potassium bromide, sodium chloride, lithium chloride, potassium iodate, potassium nitrate, potassium bromate, sodium nitrate, lithium perchlorate, ammonium nitrate phase-stabilized with potassium nitrate (AN/KN), alkali bromides, alkali borates, alkali sulfates, and combinations thereof, the chemical fire suppressant comprising from about 5 to about 40% by weight of the total composition.

In another aspect, the present invention is directed to an apparatus useful with the composition of the invention.

In another aspect, the present invention is directed to an apparatus for suppressing a fire, comprising (a) a first container containing a propellant comprising a fuel and an oxidizer, the fuel comprising from about 10 to about 50% by weight of the composition, the oxidizer comprising from about 20 to about 90% by weight of the composition, the propellant capable of generating inert gas; (b) a second container connected to the first containier by a passageway, the second container containing a coolant and an environmentally innocuous chemical fire suppressant capable of generating fire suppressive reactive species, the environmentally innoucuous chemical fire suppressant selected from the group consisting of potassium iodide, potassium bromide, sodium chloride, lithium chloride, potassium iodate, potassium nitrate, potassium bromate, sodium nitrate, lithium perchlorate, ammonium nitrate phase-stabilized with potassium nitrate (AN/KN), alkali bromides, alkali borates, alkali sulfates, and combinations thereof, the chemical fire suppressant comprising from about 5 to about 40% by weight of the total composition; and (c) an outlet between the second container and the fire.

These and other aspects will be described in more detail in the following detailed description of the invention.

DESCRIPTION OF THE DRAWINGS

The invention will be more fully understood from the following detailed description taken in conjunction with the accompanying drawings in which.

DETAILED DESCRIPTION OF THE INVENTION

Figure 1:
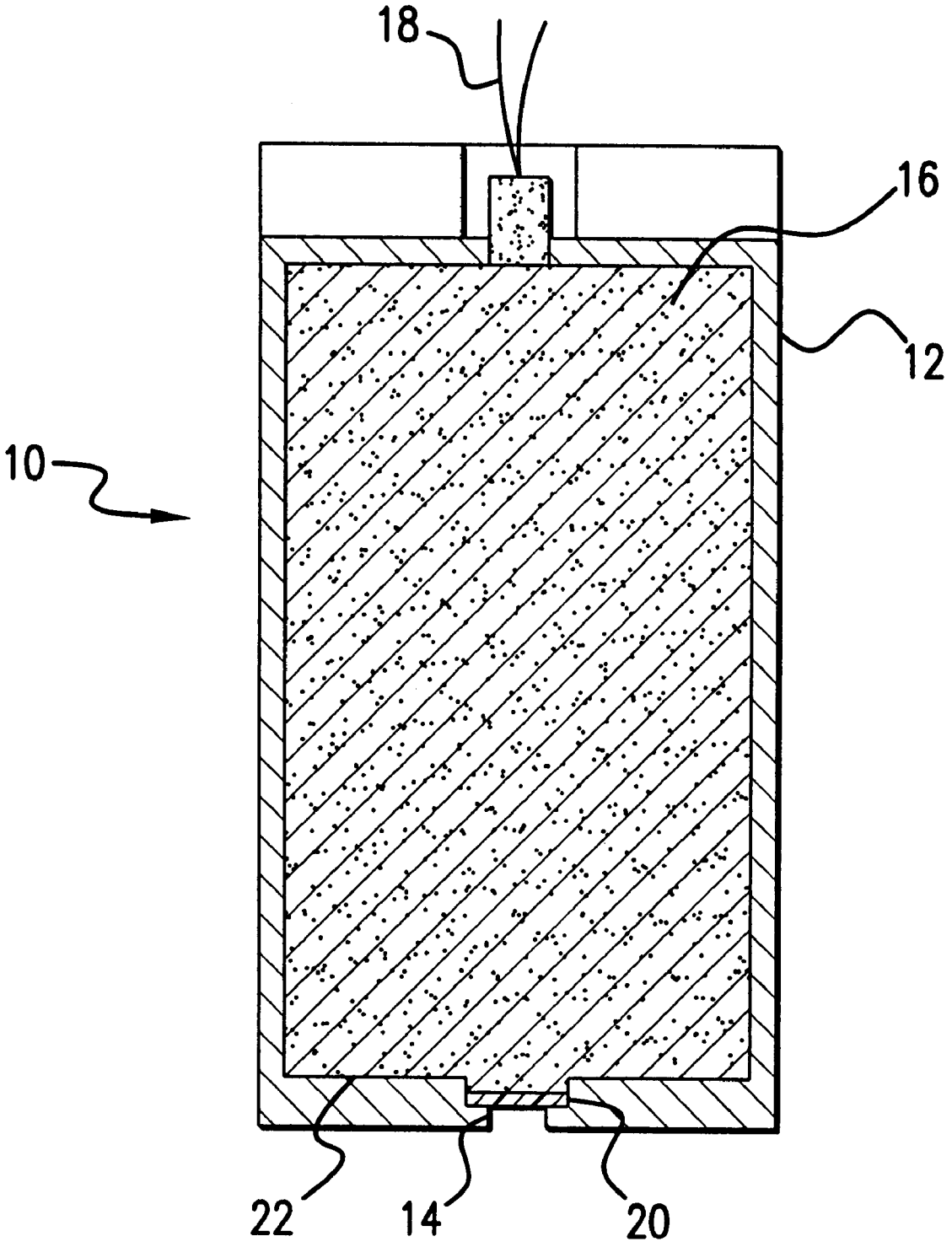
FIG. 1 is a schematic diagram of an apparatus useful with the composition of the invention.

The invention is directed to a fire suppression composition which is a combination of physically-acting and chemically-acting fire suppression agents. The physically-acting fire suppression agent is a propellant which produces large amounts of inert gas that blankets the fire and reduces the combustion temperature. The chemically-acting fire suppressive agent is a fire-suppressive reactive species which suppresses combustion reactions in a fire. The combination of inert gases and fire suppressive reactive species has suprisingly been found to result in a significant enhancement in fire suppression capability and efficiency over a physically-acting agent or a chemically acting agent individually. In addition, the fire suppressive reactive species of the present invention are environmentally innocuous and do not contribute to the destruction of the ozone layer. The fire suppression compositions of the invention display high fire suppression efficiencies on both mass and volume bases, and therefore smaller amounts of fire suppression composition are required for flame extinction. Gains in fire suppression efficiencies can exceed 50%, resulting in lower levels of agent required for flame extinction.

As indicated above, the fire suppression compositions of the invention are combinations of (1) one or more physically-acting fire suppression agents, and (2) one or more chemically-acting fire suppression agents.

The physically-acting fire suppression agent is preferably a propellant which produces large amounts of inert gases such as carbon dioxide ($CO_2$), nitrogen ($N_2$), and water vapor ($H_2O$) when ignited. Such propellants useful in the composition of the invention generally comprise energetic fuels in combination with oxidizers. Exemplary energetic fuels include 5-aminotetrazole or potassium, zinc, or other salts thereof, bitetrazole or potassium, zinc or other salts thereof, diazoaminotetrazole or potassium, zinc, or other salts thereof, diazotetrazole dimer and its salts, guanidine nitrate, aminoguanidine nitrates, nitroguanidine, triazoles (e.g., 5-nitro-1,2,4-triazol-3-one), triaminoguanidinium, diaminoguanidinium, and combinations thereof. Exemplary oxidizers include alkali metal nitrates (e.g., $NaNO_3$), alkaline earth nitrates (e.g., $Sr(NO_3)_2$, phase-stabilized ammonium nitrates (PSAN), perchlorates, iodates, and bromates.

The fuel component of the composition preferably comprises from about 5 to about 50% by weight of the total composition, and more preferably from about 10 to about 35% by weight of the total composition. The oxidizer component of the composition preferably comprises from about 20 to about 90% by weight of the total composition, and more preferably, from about 25 to about 50% by weight of the total composition. The relative amounts of fuel and oxidizer in the propellant range from about 30% fuel and 70% oxidizer, to about 70% fuel to about 30% oxidizer, all based on the total weight of the propellant.

The propellant component of the fire suppression composition of the invention generates large amounts of inert gases which function to physically extinguish the fire by the combined effects of straining the burning flame front, displacing oxygen available for combustion, and reducing the heat of the combustion source. According to the invention, approximately about 40–100 grams of inert gases can be produced from approximately 100 grams of solid propellant. The generated inert gases act as a carrier for the pyrotechnically generated chemically reactive species produced on combustion of the chemically-acting fire suppression component described in detail below.

The chemically-acting fire suppression agent is generally a chemical that generates environmentally innocuous fire suppressive reactive species that disrupt combustion processes. The chemically-acting fire suppression agent may be an agent that itself has fire suppressive properties, such as potassium iodide, potassium bromide, sodium chloride, and lithium chloride. Upon combustion of the propellant and oxidizer, the chemically-acting fire suppression agent is vaporized and swept into the fire by the gas stream.

Alternatively, the fire suppressive reactive species may be formed pyrotechnically from a secondary oxidizer. The high temperatures associated with combustion of the propellant component transforms the chemically-acting fire suppressive agent into small particles of fire suppressive reactive species that assist in extinguishing the fire. These small particles have diameters of 30 micrometers or less and result in a large surface area of chemically reactive species that quickly disrupts the combustion process. The large surface area and great fire suppressive activity of the chemically reactive particles contributes to significant mass-efficiency of solid propellant systems used for fire suppression. One preferred secondary oxidizer is potassium iodate ($KIO_3$) which generates potassium iodide (KI) pyrotechnically upon combustion. Additional agents that form fire-suppressive reactive species pyrotechnically include potassium nitrate, potassium bromate, sodium nitrate, lithium perchlorate, ammonium nitrate phase-stabilized with potassium nitrate (AN/KN), alkali bromides such as potassium bromide, alkali borates such as potassium borate, and alkali sulfates such as potassium sulfate. When combusted, these compounds result in pyrotechnic generation of $K_2CO_3$, $Na_2CO_3$, or halide salts such as KBr, KI, NaCl, LiCl which are superior fire suppressants.

The above chemically-acting fire suppressive agents offer several advantages over the halon-based fire suppressive chemicals. Unlike Halons, the chemically-acting fire suppressive agents are mainly environmentally innocuous salts which are not volatile. Accordingly, these chemically-acting fire suppression agents are not subjected to high altitade photolysis and therefore do not contribute to ozone destruction. Rather, heat generated on combustion of the propellant forms fire suppressive reactive species pyrotechnically which act locally to suppress the fire. Additionally, the fire suppressive reactive species generated on combustion in the composition of the invention may be reformed to their environmentally innocuous parent salts. These salts may be washed away by rain or water applied by firefighting personnel.

Potassium species are particularly useful as chemically-acting fire suppressive agents because they have been shown to possess significant levels of fire suppressive activity. Among the halides, iodide salts show the greatest efficiency at fire suppression because of the greater stability of their atomic radicals. Without being bound by any particular theory, it is thought that on delivery to the fire zone, elevated temperatures cause thermal dissociation of the halide salts, e.g., $KI \rightarrow K.+I.$ The thermally-generated atomic radicals then combine with radical species present in the combustion reaction, thereby terminating or quenching the combustion process.

The chemically-acting fire suppression agent of the composition preferably comprises from about 5 to about 50% by weight of the total composition, and more preferably from about 5 to about 30% by weight of the total composition.

The composition may include other additives to enhance the taco fire suppression capability. Coolants, such as magnesium carbonate ($MgCO_3$) or magnesium hydroxide ($Mg(OH)_2$) may be added to further reduce the combustion temperature and enhance fire suppression efficiency. Coolants preferably comprise from about 0 to about 40% by weight of the total composition, and more preferably from about 5 to about 35% by weight of the total composition.

Optionally, binders such as thermoplastic rubbers, polyurethanes, polycarbonates, polysuccinates, polyethers, and the like may also be added to the composition. Binders act to hold the active materials together when the propellant is in its finished form. Plasticizers and processing aids may also be added to the composition to enhance processing. Generally, binders, plasticizers, or processing aids are optionally present in the composition from about 0–15% by weight, based on the total weight of the composition.

The composition results in production of fire suppressive agents that do not have an adverse impact on the environment. The gases produced from the physically-acting fire suppression component are all nonhazardous, nonflammable, and comprise significant fractions of the natural atmosphere. The chemically-acting fire suppression component also produces nonhazardous, water soluble species that do not destroy amospheric ozone. In addition, in the event of accidental discharge, the chemically reactive species may be easily washed out of the atmosphere by normal precipitation.

The combination of energetic fuel and oxidizer in the propellant component of the composition advantageously allows for large amounts of inert gas to be produced from relatively small amounts of solid propellant material. As a result, more compact fire extinguishing device may be employed. Use of compact fire extinguishing devices is particularly desirabe in applications where space is limited, for example automobiles, space vehicles, commercial or military aircraft or ships, submarines, or treaded vehicles such as tanks. Compact fire extinguishing devices may also be used in cargo spaces, closed electronic cabinets, paint or ammunition lockers, or any other confined space.

The fire suppression composition of the invention may be generally prepared by combining appropriate amounts of fuel, oxidizer, and chemically-acting fire suppressant along with optional ingredients such as coolants, binders, or plasticizers. These ingredients are mixed to produce a homogeneous blend of particles. The homogeneous blend may be compacted into pellets or compressed into a storage vessel of a fire extinguishing apparatus using conventional compaction techniques known in the art. The composition of the invention may be used as a replacement for commercially available fire suppression agents that act exclusively as physically-acting agents or environmentally hazardous chemically-acting agents.

FIG. 1 is a schematic diagram of a fire extinguishing apparatus useful with the composition of the invention. As shown in FIG. 1, the apparatus 10 includes a gas generator 12 and a passageway 14 attached to the bottom 22 of the gas generator 12. The chemically active fire suppression composition of the invention 16 is placed in interior of the gas generator 12. In this particular embodiment, the chemically active fire suppression composition 16 includes a propellant made from a fuel and an oxidizer, and an environmentally innocuous chemical fire suppressant. As described above, the propellant generates inert gases to physically smother the fire, while the environmentally innocuous chemical fire suppressant generates fire suppressive reactive species upon combustion to extinguish the fire chemically.

An electric initiator 18 is attached to the top of the gas generator 12 to ignite the chemically active fire suppression composition 16 when a fire is detected. After ignition, chemically-acting and physically-acting fire suppressive gases are generated inside the gas generator 12. As these gases are generated, pressure inside the gas generator 12 increases to a point at which the seal 20 attached to the bottom 22 of the gas generator 12 is broken and the fire suppressive gases are released onto the fire.

Figure 2:
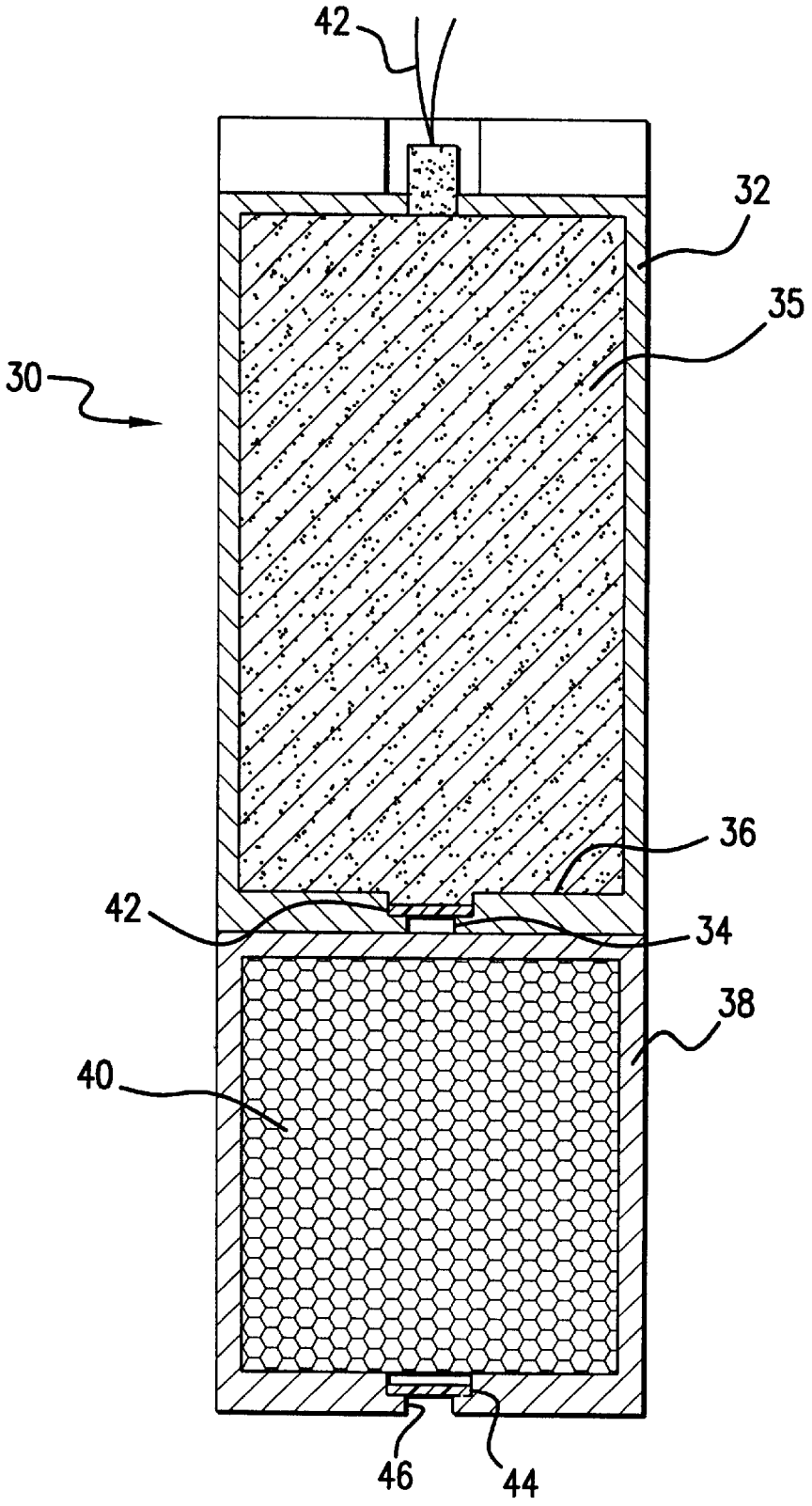
FIG. 2 is a schematic diagram of another apparatus useful with the composition of the invention.

FIG. 2 shows an alternative embodiment of a fire extinguishing apparatus useful with the composition of the invention. In this exemplary embodiment, the apparatus 30 includes a gas generator 32 containing the propellant component 35 of the chemically active fire suppression composition, and a passageway 34 attached to the bottom 36 of the gas generator 30. This passageway 34 is attached to a secondary container 38 that contains a bed 40 that includes the chemical fire suppression component, as well as optional ingredients such as one or more coolants.

An electric initiator 42 is attached to the top of the gas generator 32 to ignite the propellant component 35 when a fire is detected. After ignition, the propellant component 35 generates hot, physically-acting fire suppressive gases that build pressure within the gas generator 32. The built-up pressure breaks a seal 42 positioned over the passageway 34, and permits the hot, physically-acting fire suppressive gases to pass through the passageway 34 and enter the secondary container 38. Once inside the secondary container 38, the hot, physically-acting fire suppressive gases volatilize the chemical fire suppression component and any optional coolants to produce a combination of physically-acting fire suppressive gases and chemically-acting fire suppressive gases. The coolant keeps the hot gases within a specified temperature range, preferably 1500° F. or lower. The pressure of the chemically acting fire suppressive gases raises the total pressure within the secondary container 38 and causes a secondary seal 44 to break, thereby releasing the combination of physically-acting and chemically-acting fires suppressive gases through the outlet 46 and onto the fire.

The combination of physically acting fire suppression agents and chemically acting, environmentally innocuous fire suppression agents results in a highly effective, environmentally innocuous fire extinguishing composition that has low ozone depletion potential (ODP), low global warming potential (GWP), and high suppression efficiency.

The invention is further described by the following Examples, but is not intended to be limited by the Examples. All parts and percentages are by weight and all temperatures are in degrees Celsius unless explicitly stated otherwise.

EXAMPLES

Comparison testing of purely physical agents, e.g. nitrogen gas, and mixed physical/chemical agents, e.g. nitrogen gas with potassium iodide (KI) indicate that their combination can lead to improved efficiency in fire suppression. Significant reductions in the amount of nitrogen needed for extinction can be achieved if KI is added to the nitrogen feed stream. Likewise, by using inert gases like nitrogen rather than air entrainment for delivery, significant reductions can be achieved in the amount of KI necessary for flame extinction.

Example 1

A quantity of fine particle size potassium iodide (KI) was prepared by grinding in a ball mill. Varying ratios of powdered KI/$N_2$ and were delivered into the airstream of a turbulent spray burner in order to determine lower limits for flame extinction. A total of 0.65 g of $N_2$ were required to extinguish a fire. Adding 0.1 g KI to the $N_2$ stream reduced the required $N_2$ to 0.2 g for flame extinction. Thus, a combination of a physically-acting fire suppressant and chemically-acting fire suppressant is over 50% more efficient than a physically-acting fire suppressant alone.

Example 2

A mixture 17.2 g 5-aminotetrazole (5-AT), 30.0 g strontium nitrate ($Sr(NO_3)_2$) and 16.0 g magnesium carbonate ($MgCO_3$) was blended in a ball mill to produce a homogenous mixture of uniformly sized particles. To this mixture was added a 21.3 g of finely powdered potassium iodide (KI) and the combination was thoroughly mixed in the ball mill. Portions of the resulting material were compression molded at approximately 8500 pounds force to form pellets of approximately one-half inch in diameter, one-half inch in length and 3 g mass. The pellets made as described above were coated on the sides with an epoxy-titanium oxide inhibitor to prevent burning along the sides. The burning rate of the pellets was evaluated by measuring the time required to burn a cylindrical pellet of known length. The burning rate of this composition was approximately 0.51 in/sec at 1000 psi.

This composition yielded approximately 42 g inert gas and 21 g KI/100 g, with a calculated adiabatic flame temperature of 1446 K. Fire suppression testing of this material indicated that 0.6 g of propellant was required for extinction of a turbulent spray flame.

Example 3

A mixture of 20.1 wt % 5-aminotetrazole, 35.1 wt % strontium nitrate, 36.8 wt % magnesium carbonate and 8 wt % potassium iodide was blended in a ball mill to produce a homogenous mixture of particles. Portions of the resulting material were compression molded at approximately 8500 pounds of force to form pellets of approximately one-half inch in diameter, one-half inch in length, and 3 g mass. The pellets made as described above were coated on the sides with epoxy-titanium oxide inhibitor to prevent burning along the sides. The burning rate was evaluated by measuring the time required to burn a cylindrical pellet of known length. Turbulent spray flame evaluation showed that this material yielded an enhancement of 33% in fire suppression efficiency over an analogous composition without potassium iodide.

While the invention has been described in combination with embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims. All patent applications, patents, and other publications cited herein are incorporated by reference in their entireties.

What is claimed is:

1. An apparatus for suppressing a fire, comprising:

(a) a first container containing a propellant comprising a fuel and an oxidizer, said fuel comprising from about 10 to about 50% by weight, based on the total weight of said composition, said oxidizer comprising from about 20 to about 90% by weight, based on the total weight of said composition, said propellant capable of generating inert gas;

(b) a second container connected to said first container by a passageway, said second container containing a coolant and an environmentally innocuous chemical fire suppressant capable of generating fire suppressive reactive species, said environmentally innocuous chemical fire suppressant selected from the group consisting of potassium iodide, potassium bromide, lithium chloride, potassium iodate, potassium nitrate, potassium bromate, sodium nitrate, lithium perchlorate, ammonium nitrate phase-stabilized with potassium nitrate (AN/KN), and combinations thereof, said chemical fire suppressant comprising from about 5 to about 40% by weight, based on the total weight of said composition; and (c) an outlet between said second container and said fire.

2. The apparatus of claim 1, wherein said fuel is selected from the group consisting of 5-aminotetrazole or salts thereof, bitetrazole or salts thereof, diazoaminotetrazole or salts thereof, diazotetrazole dimer or salts thereof, guanidine nitrate, aminoguanidine nitrates, nitroguanidine, 5-nitro-1,2,4-triazol-3-one, triaminoguanidinium, diaminoguanidinium, and combinations thereof.

3. The apparatus of claim 1, wherein said oxidizer is selected from the group consisting of alkali metal nitrates, alkaline earth nitrates, phase stabilized ammonium nitrates, perchlorates, iodates, bromates, and combinations thereof.

4. The apparatus of claim 1, wherein said chemically active fire suppression composition further comprises a coolant.

5. The apparatus of claim 1, wherein said second container further comprising a coolant.

6. The apparatus of claim 5, wherein said coolant is $MgCO_3$.

* * * * *

UNITED STATES PATENT AND TRADEMARK OFFICE

CERTIFICATE OF CORRECTION

PATENT NO. : 6,024,889

DATED : February 15, 2000

INVENTOR(S) : Gary F. Holland, et al

It is certified that error appears in the above-identified patent and that said Letters Patent is hereby corrected as shown below:

Cancel claims 4 and 5.

Column 8, line 64, change "5." to --1--.

Signed and Sealed this

Twenty-seventh Day of June, 2000

*Attest:*

Q. TODD DICKINSON

*Attesting Officer*

*Director of Patents and Trademarks*